US005841224A

United States Patent [19]

Kim et al.

[11] Patent Number: 5,841,224

[45] Date of Patent: Nov. 24, 1998

[54] SECOND GRID FOR AN ELECTRON GUN HAVING APERTURES AND ROTARY ASYMMETRICAL PORTIONS FACING THE FIRST AND THIRD GRIDS

[75] Inventors: Won Hyun Kim, Kyungsangbuk-do; Hee Won Yun; Sung Kil Kim, both of Daeku-si; Hyun Chul Kim, Kyungsangbuk-do; Sung Ho Cho, Kyungsangbuk-do; Sung Ki Ahn, Kyungsangbuk-do, all of Rep. of Korea

[73] Assignee: Goldstar Co., Ltd., Seoul, Rep. of Korea

[21] Appl. No.: 361,376

[22] Filed: Dec. 22, 1994

[30] Foreign Application Priority Data

Jul. 7, 1994 [KR] Rep. of Korea ..... 1994/16384

[51] Int. Cl.[6] ..... H01J 29/56; H01J 29/51

[52] U.S. Cl. ..... 313/412; 313/414

[58] Field of Search ..... 313/412, 413, 313/414, 426, 427, 428

[56] References Cited

U.S. PATENT DOCUMENTS

| | | | |
|---|---|---|---|
| 4,234,814 | 11/1980 | Chen et al. | 313/412 |
| 4,242,613 | 12/1980 | Brambring et al. | 313/447 |
| 4,358,703 | 11/1982 | Bijma et al. | 313/448 |
| 4,523,123 | 6/1985 | Chen | 313/414 |
| 4,558,253 | 12/1985 | Bechis et al. | 313/414 |
| 4,608,515 | 8/1986 | Chen | 313/414 X |
| 4,629,933 | 12/1986 | Bijma et al. | 313/414 |
| 4,825,121 | 4/1989 | Miyazaki | 313/414 |
| 4,891,549 | 1/1990 | Kniesser et al. | 313/414 |
| 5,066,887 | 11/1991 | New | 313/414 |
| 5,198,719 | 3/1993 | Koh | 313/412 X |
| 5,412,277 | 5/1995 | Chen | 313/412 X |

FOREIGN PATENT DOCUMENTS

| | | |
|---|---|---|
| 4-33099 | 4/1992 | Japan . |
| 5-258682 | 8/1993 | Japan . |

*Primary Examiner*—Sandra L. O'Shea
*Assistant Examiner*—Jay M. Patidar
*Attorney, Agent, or Firm*—Fish & Richardson P.C.

[57] ABSTRACT

An electron gun for a large-sized color cathode ray tube has three cathodes heated by a heater for emitting thermoelectrons, a first grid for controlling emitted electron beams on one side of the cathodes, a second grid for attracting the thermoelectrons gathered on the cathodes on one side of the first grid, a plurality of electrodes sequentially arranged on the second grid for accelerating and focusing the incoming electron beams, and a bead glass for fixing the electrodes spaced apart by predetermined distances, in which the thickness of the second grid is varied to decrease the divergence angle of the electron beams, and horizontal slits being rotary asymmetrical portions are formed in both sides around electron beam passing holes to contrive a quadrupole effect, thereby compensating for distortion of the electron beams on the periphery of a screen caused by a deflection aberration to thus improve resolution of large-sized Brawn tubes.

11 Claims, 10 Drawing Sheets

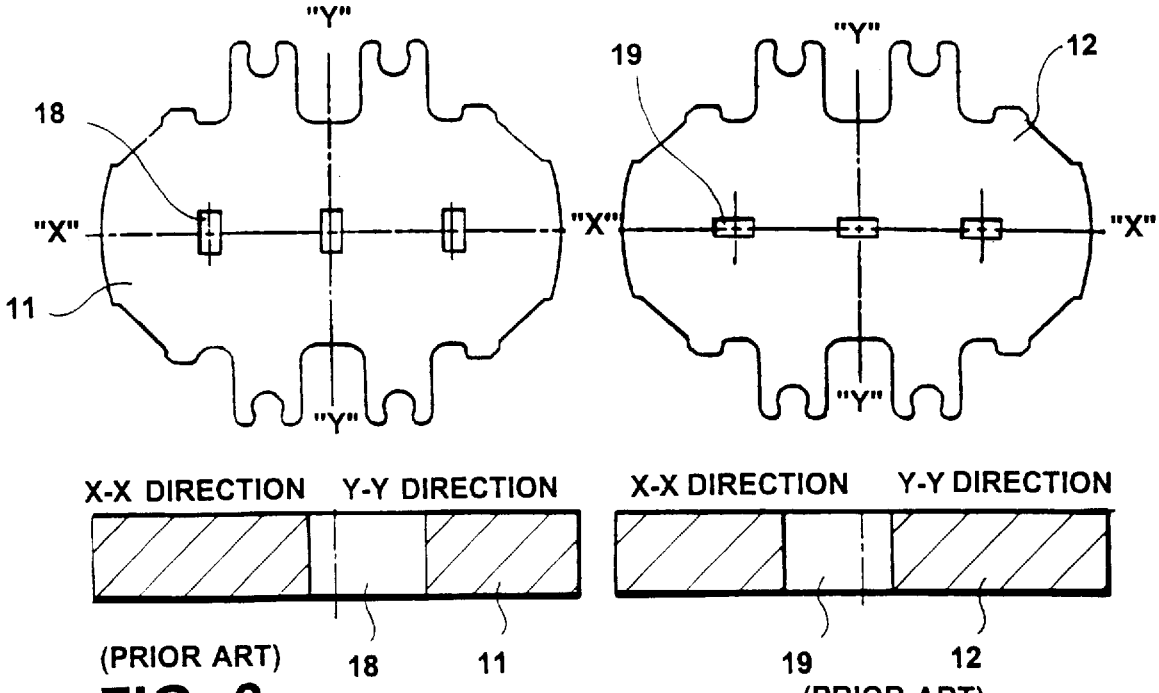
(PRIOR ART)
FIG. 6a
(PRIOR ART)
FIG. 6b
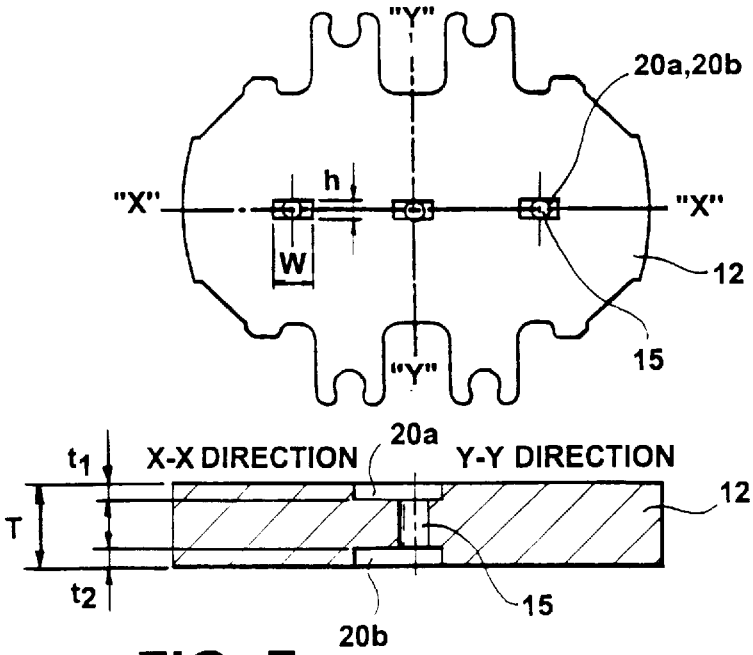
FIG. 7

SECOND GRID FOR AN ELECTRON GUN HAVING APERTURES AND ROTARY ASYMMETRICAL PORTIONS FACING THE FIRST AND THIRD GRIDS

BACKGROUND OF THE INVENTION

1. Field of the Invention

The present invention relates to a second grid for attracting thermoelectrons gathered around a cathode of an electron gun for a color cathode ray tube (hereinafter referred to as "CCRT"), and more particularly to a second grid suitable for improving resolution of a large-sized Brawn tube.

2. Description of the Prior Art

As shown in FIG. 1, a CCRT generally has a panel 1 on the front side thereof, a neck 2 on the rear portion, and a funnel 3 for being integrally formed with the above two members. An electron gun 5 for emitting RGB electron beams 4 is sealed in the neck 2, and a phosphor layer 6 being luminous in three colors by the collision of the electron beams from the electron gun 5 is coated on the inside of the panel 1. A shadow mask 7 having a perforated structure or a plurality of circular apertures therein is formed adjacent to and spaced apart from the phosphor layer 6 by a predetermined distance while being fixed to a support frame 8 via a laser welding. Also, a deflection yoke 9 for deflecting the electron beams from the electron gun 5 is fixed onto the outer circumference of the neck 2.

FIG. 2 is a side view of the electron gun for emitting the electron beams onto the phosphor layer 6. The electron gun includes three cathodes 10 heated by a heater (not shown) at the inside of the electron gun for emitting the thermoelectrons in accordance with the received RGB electrical signals, a first grid 11 located on one side (toward the phosphor layer) of the cathodes 10 for controlling the electron beams from the cathodes 10, a second grid 12 located on one side of the first grid 11 for directing to accelerate the thermoelectrons gathered on the cathodes 10, and a main focusing lens consisting of a plurality of electrodes 13 sequentially located on one side of the second grid 12 for accelerating to focus the incoming electron beams. The electrodes arranged as an in-line type are integrally formed with a bead glass 14 which is an electrical insulation member of a bar shape.

The above-described electrodes have three electron beam passing holes 15 in the in-line direction of a plane which is perpendicular to the advancing direction of the electron beams. The three electron beam passing holes 15 are respectively formed in the same plane of the respective electrodes. Among the electrodes, as shown in FIGS. 3 and 4, the first grid 11 and second grid 12 included in a triode are plate-type electrodes and have three circular electron beam passing holes 15 in the horizontal direction for allowing the electron beams to be passed.

The CCRTs adopting the above-stated electron gun are being gradually enlarged to require a wide deflection angle, thereby significantly emphasizing the resolution of a screen.

Three methods have been proposed to improve the resolution of the screen.

The first method is for permitting the main focusing lens to have an effectively large aperture to thus decrease the influence of spherical aberration. The second is for using a dynamic quadrupole lens to eliminate deflection defocusing and astigmatism on the periphery of the screen; and the third is for reasonably designing the first and second grids being the triode to control the deflection aberration on the periphery of the screen.

The in-line type electron gun applied with the conventional triode as shown in FIGS. 3 and 4 is severely subjected to a deflection magnetic field on the periphery of the screen because of a self-convergence magnetic field, so that the electron beam is distorted. Due to this fact, the electron beam favorably deflects on the horizontal plane, but components vertically apart from the electron beam on the horizontal plane are intensely over-focused and deflect in the vertical direction while being distorted by the influence of the spherical aberration of the main focusing lens.

In order to prevent the resolution from being degraded by the distortion of the electron beam owing to the quadrupole property of the self-convergence magnetic field, several methods for designing an asymmetric triode have been suggested.

FIG. 5 illustrates a technique well-known from U.S. Pat. Nos. 4,242,613, 4,358,703 and 4,629,933 and Japanese Laid-open Publication No. Hei 5-258682.

In the above technique, the electron beam passing holes 15 of the first grid 11 are formed in such a manner that a vertical slit 16 is formed toward the cathode 10 and a horizontal slit 17 is formed toward the second grid 12 to differently form the crossover points in the horizontal and vertical directions of the electron beams when the electron beam passes through the triode. In other words, the crossover point in the vertical direction is nearer to the main focusing lens than that in the horizontal direction, and the electron beam having passed through the main focusing lens is then emitted in the vertically-elongated form. Accordingly, the distortion of the electron beam caused by the deflection magnetic field is compensated in advance.

However, the triode constructed as above cannot compensate for the distortion of the electron beam in advance, because the positional ratio of the crossover points in the vertical and horizontal directions varies when the amount of the electron beam is increased (that is, when beam current is increased). Additionally, since the first grid 11 must be thin enough to be approximately below 0.1 mm around the electron beam passing holes 15, the parts processing is very disadvantageous in forming the vertical and horizontal slits 16 and 17 on both sides of the electron beam passing holes 15.

A technique illustrated with reference to FIG. 6 is disclosed in U.S. Pat. No. 4,558,253.

Here, a vertical slit 18 is formed in the first grid 11 as shown in FIG. 6A and a horizontal slit 19 is in the second grid 12 as shown in FIG. 6B to function as the slits of FIG. 5. More specifically, the crossover point in the vertical direction is formed nearer to the main focusing lens than that in the horizontal direction to obtain the effect same as the foregoing description.

This technique, however, cannot expect the above-described effect in case of the increased beam current for the same reason that applies to the technique of FIG. 5. Furthermore, when the first and second grids having the horizontal and vertical slits are assembled together with other electrodes, it is difficult to align the electron beam passing holes formed in the respective electrodes around the centers of them in the same axis. By this reason, the electron beam induces coma aberration and degrades the resolution.

SUMMARY OF THE INVENTION

The present invention is devised to solve the above-described problems. Accordingly, it is an object of the present invention to provide an electron gun of a CCRT having a reduced thickness in the second grid to decrease the divergence angle of the electron beams and by forming horizontal slits in both sides of the second grid to contrive a quadrupole effect, thereby compensating for distortion of the electron beams on the periphery of a screen caused by a deflection aberration.

To achieve the above object of the present invention, there is provided an electron gun for a CCRT. The electron gun includes three cathodes heated by a heater for emitting thermoelectrons, and a first grid placed on one side of the cathodes for controlling the emitted thermoelectrons. Furthermore, a second grid is placed on the side of the first grid opposite to said cathode to attract and accelerate the thermoelectrons gathered around the cathodes, a plurality of electrodes are sequentially placed on the side of the second grid opposite to said first grid to accelerate and focus the incoming electron beams, and a bead glass fixes the respective electrodes spaced apart by predetermined distances. Here, especially, the second grid is formed to have rotary asymmetrical portions on both sides around the electron beam passing hole thereof.

BRIEF DESCRIPTION OF THE DRAWINGS

The above objects and other advantages of the present invention will become more apparent by describing in detail preferred embodiments thereof with reference to the attached drawings in which:

FIGS. 6A and 6B are front views and sectional views respectively showing still other examples of the conventional first and second grids;

FIG. 7 is a front view and a sectional view showing one embodiment of a second grid according to the present invention;

FIGS. 11*a* and 11*b* (hereinafter, referred to collectively as "FIG. 11") are graph representations plotting the trajectory of electron beams in the beam focusing region of the electron gun according to the present invention, wherein FIG. 11*a* is a graph plotted along the horizontal direction, and FIG. 11*b* is a graph plotted along the vertical direction;

DETAILED DESCRIPTION OF THE PREFERRED EMBODIMENTS

FIG. 7 illustrates one embodiment of a second grid in an electron gun for a large-sized CCRT according to the present invention.

According to the present invention, rotary asymmetric portions are formed in both sides around an electron beam passing hole 15 of a second grid 12 which forms a triode.

The rotary asymmetric portion is provided by forming horizontal slits 20*a* and 20*b* toward a first grid 11 and main focusing lens, respectively. The horizontal slits 20*a* and 20*b* are formed simultaneously with the electron beam passing hole 15 in the second grid 12.

Figure 1:
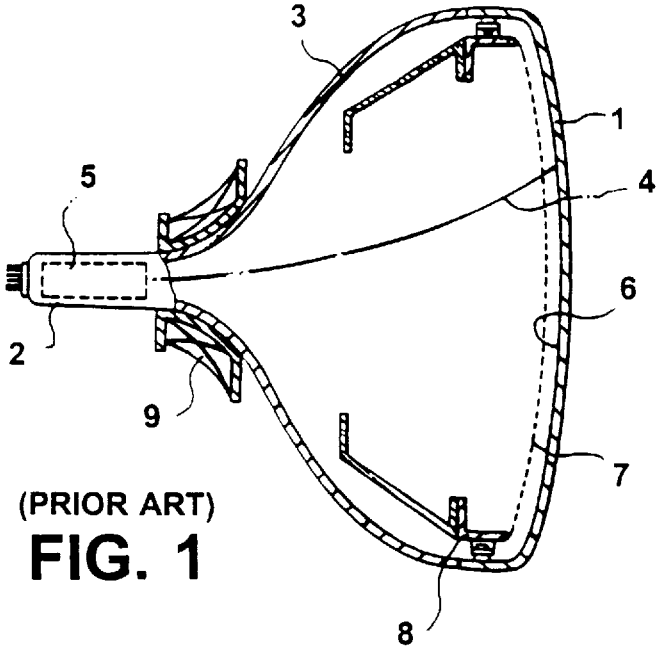
(PRIOR ART) FIG. 1
FIG. 1 is a vertical sectional view showing a general color cathode ray tube.
Figure 2:
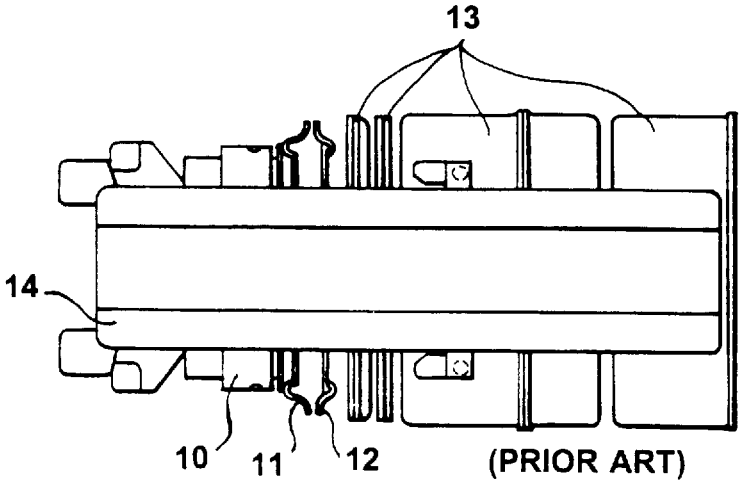
(PRIOR ART) FIG. 2
FIG. 2 is a side view showing the electron gun applied to the color cathode ray tube of FIG. 1.
Figure 3:
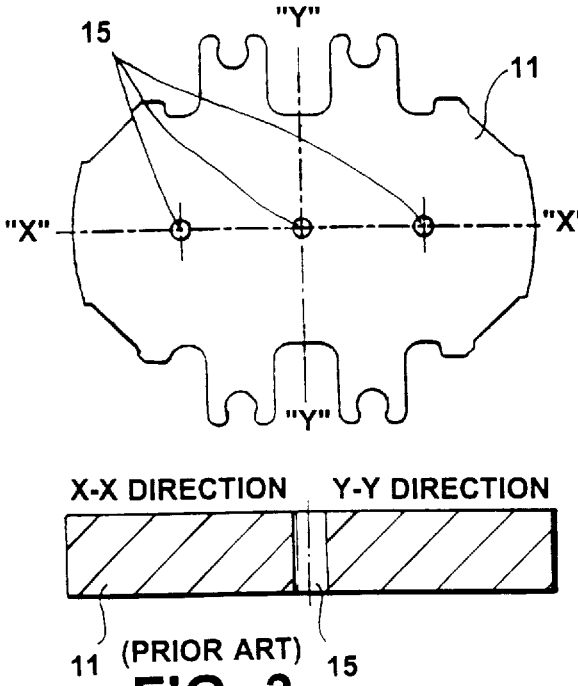
(PRIOR ART) FIG. 3
FIG. 3 is a front view and a sectional view showing one example of a conventional first grid.
Figure 4:
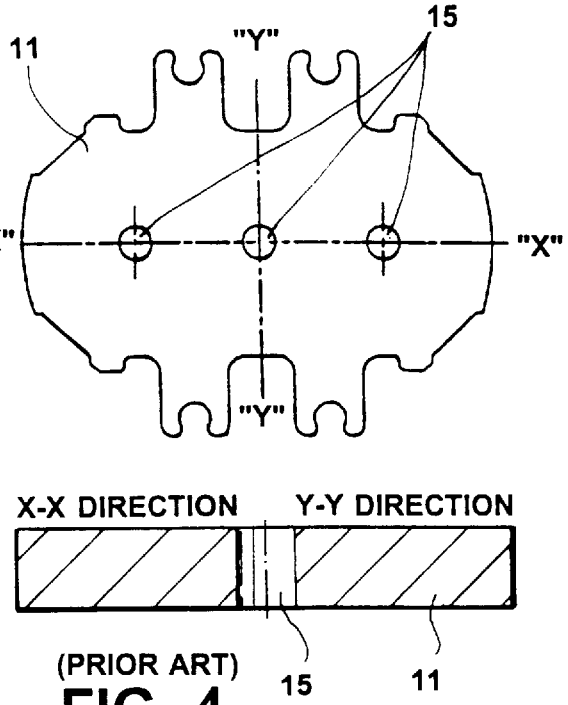
(PRIOR ART) FIG. 4
FIG. 4 is a front view and a sectional view showing one example of a conventional second grid.
Figure 5:
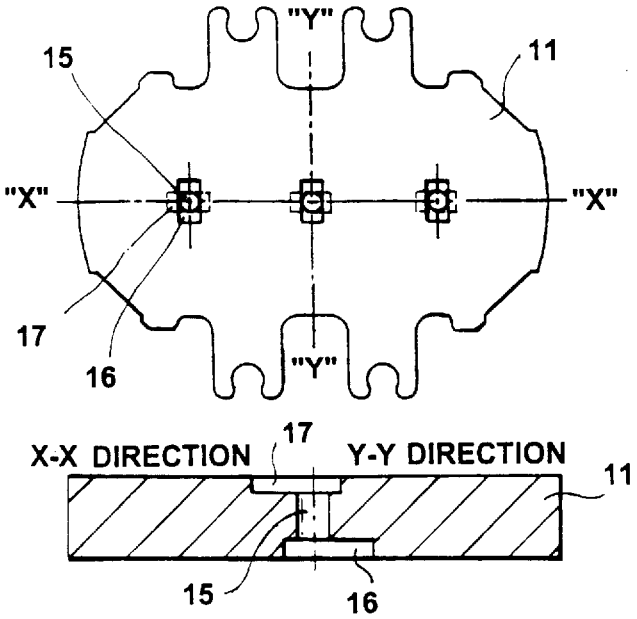
(PRIOR ART) FIG. 5
FIG. 5 is a front view and a sectional view showing another example of a conventional first grid.
Figure 8:
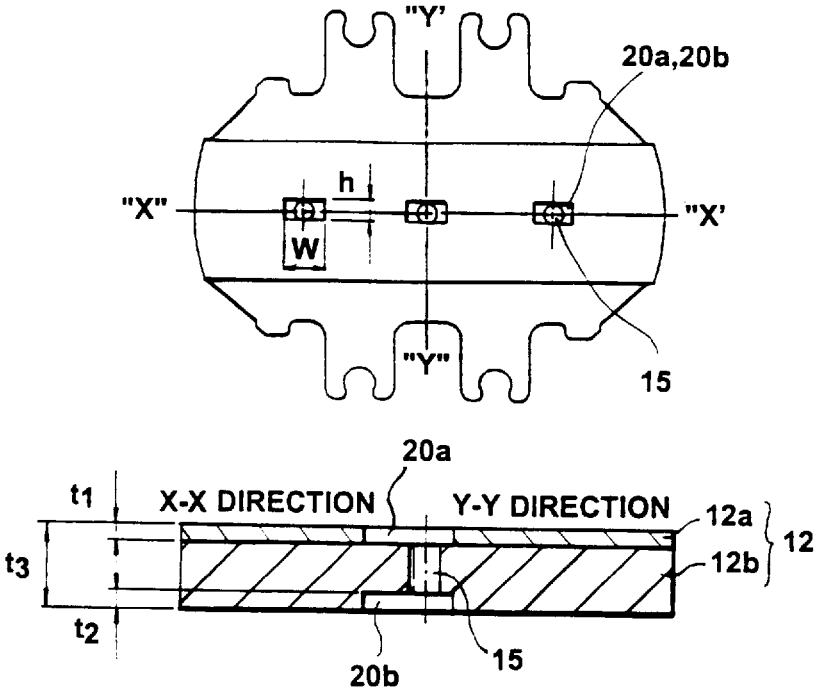
FIG. 8 is a front view and a sectional view showing another embodiment of the second grid according to the present invention.
Figure 9:
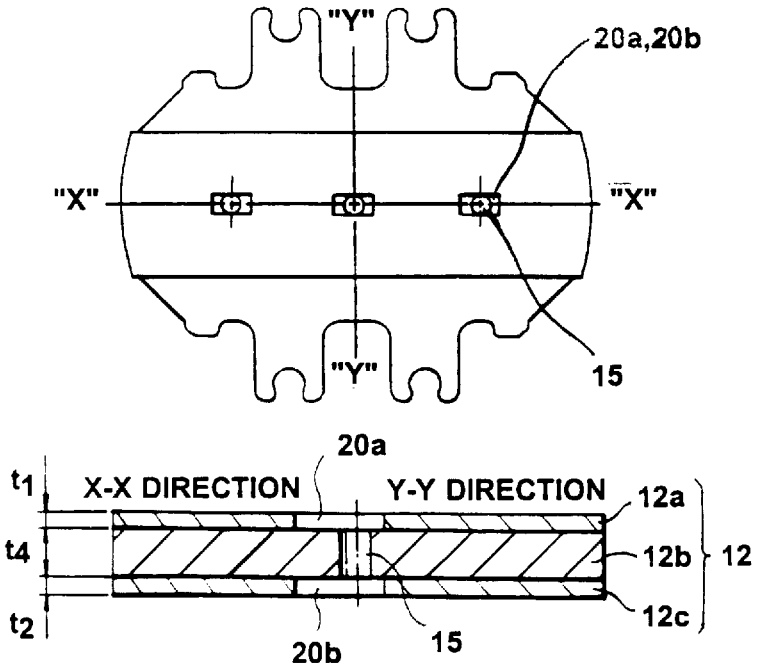
FIG. 9 is a front view and a sectional view showing still another embodiment of the second grid according to the present invention.

FIG. 8 is a front view and a sectional view illustrating another embodiment of the present invention, and FIG. 8 is a front view and a sectional view illustrating still another embodiment of the present invention. Here, the designing dimensions and shapes of respective elements are the same as those of the embodiment shown in FIG. 7, whereas the second grid 12 is separately processed as two plate electrodes 12*a* and 12*b* as shown in FIG. 8 or as three plate electrodes 12*a*, 12*b* and 12*c* as shown in FIG. 9, and then welded.

In FIG. 8, the second grid 12 is constructed by separating the plate electrode 12*b* to form the horizontal slit 20*a* facing with the main focusing lens in the separated plate electrode 12*a*. In FIG. 9, the plate electrode 12*b* is separated to form the horizontal slit 20*a* facing with the main focusing lens and the horizontal slit 20*b* facing the first grid 11 in the separate plate electrodes 12*a* and 12*c*.

The specific design dimensions of the second grid forming the triode of the electron gun are as below.

The electron beam passing hole b is set to 0.67 mm; the width w of the horizontal slit is 1.4 mm; the height h of the horizontal slit is 0.85 mm; the thickness T of the second grid shown in FIG. 7 is 0.4 mm; the thickness t1 of the horizontal slit 20*a* is 0.1 mm; the thickness t2 of the horizontal slit 20*b* is 0.1 mm; the thickness t3 of the second grid shown in FIG. 8 is 0.3 mm; and the thickness t4 of the plate electrode 12*b* is 0.2 mm.

Hereinafter, the operation and effect of the present invention formed as above will be described in detail.

Figure 10:
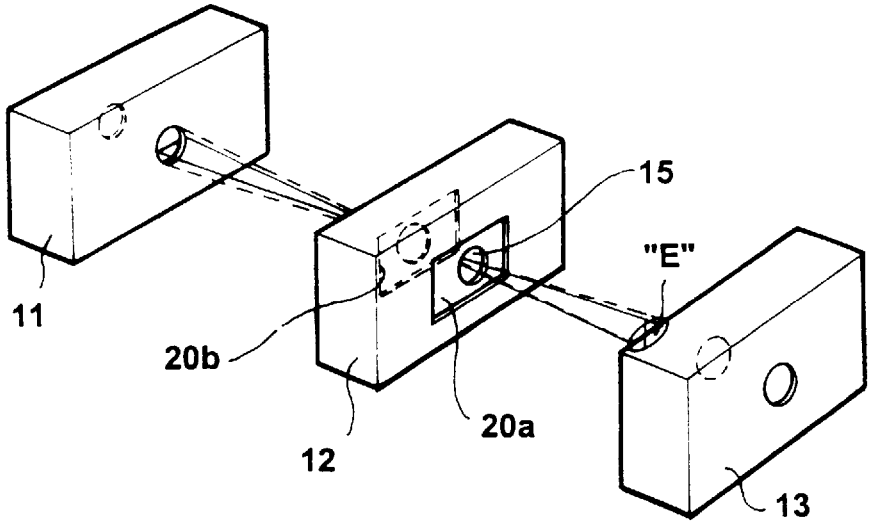
FIG. 10 is a perspective view for illustrating the concept of the electron optics according to the present invention.

As shown in FIG. 10, the electron gun according to the present invention form a quadrupole electrostatic lens by means of the horizontal slits 20*a* and 20*b* which are the rotary asymmetric portions formed in both sides around the electron beam passing hole 15 of the second grid 12, wherein the quadrupole electrostatic lens varies the divergence angle of the electron beam in the vertical and horizontal directions. In other words, the divergence angle in the vertical direction is decreased less than that in the horizontal direction to produce the electron beam having a sectional view as at reference symbol "E".

The electron beam having the above shape counteracts the distortion caused on an image while passing through the main focusing lens. As a result, the degradation of resolution on the periphery of a screen is prevented. At this time, the distortion refers that, since the electron beam components in the vertical direction are under-focused to allow the electron beam spot to be shaped as a vertical ellipse on the center of the screen (i.e., a portion unaffected by a deflection magnetic field of a deflection yoke), the electron beam is distorted in the vertical direction due to the quadrupole property of the deflection magnetic field when the electron beam deflects toward the periphery of the screen as a result of the deflection yoke (i.e., the influence of deflection aberration).

The second grid according to the present invention is designed to equate the positions of the crossover points in the horizontal and vertical directions while differing the divergence angle of the electron beam. Therefore, even though the electron beam current is increased, the characteristic values are hardly changed.

Figure 11A:
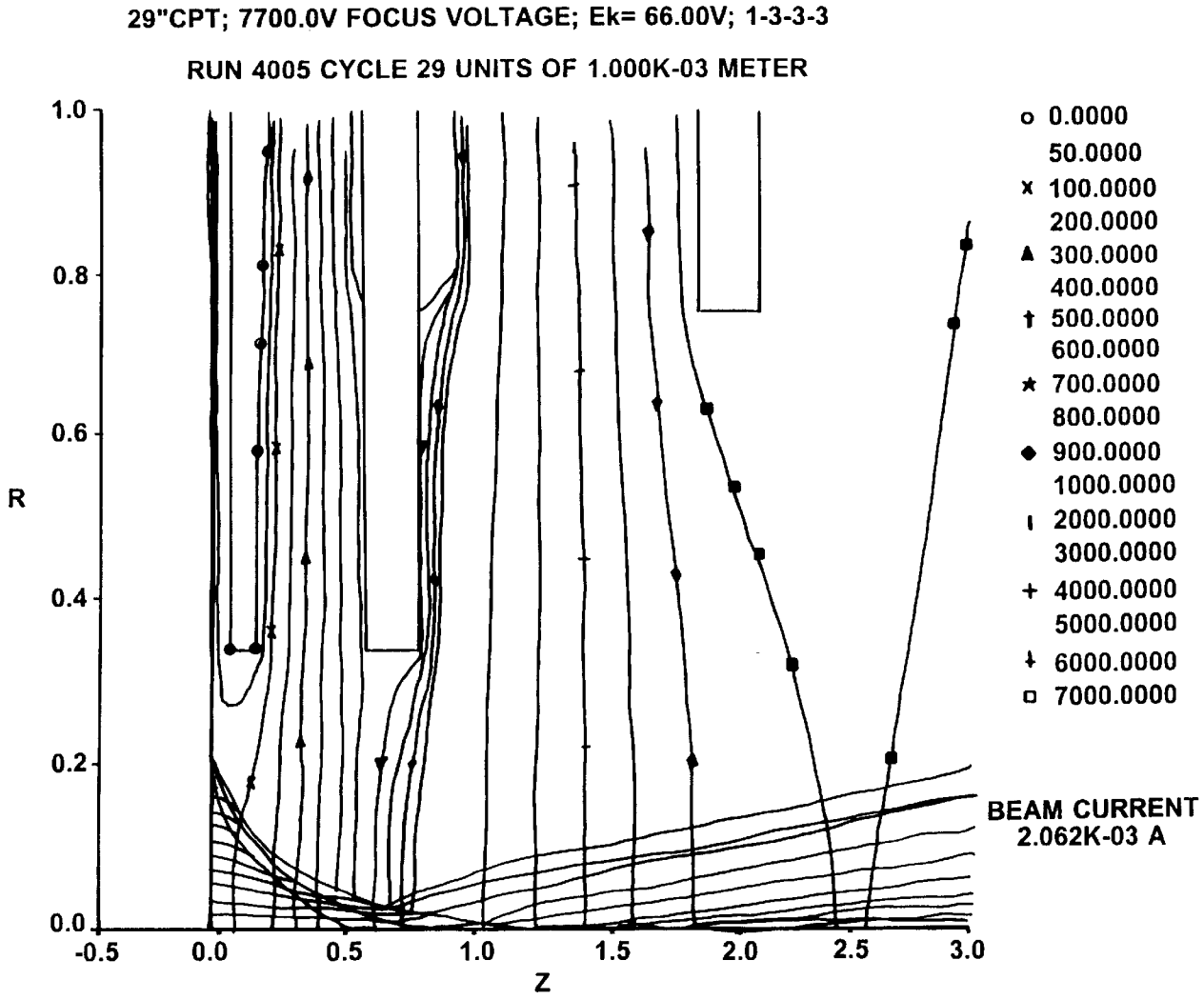
Figure 11B:
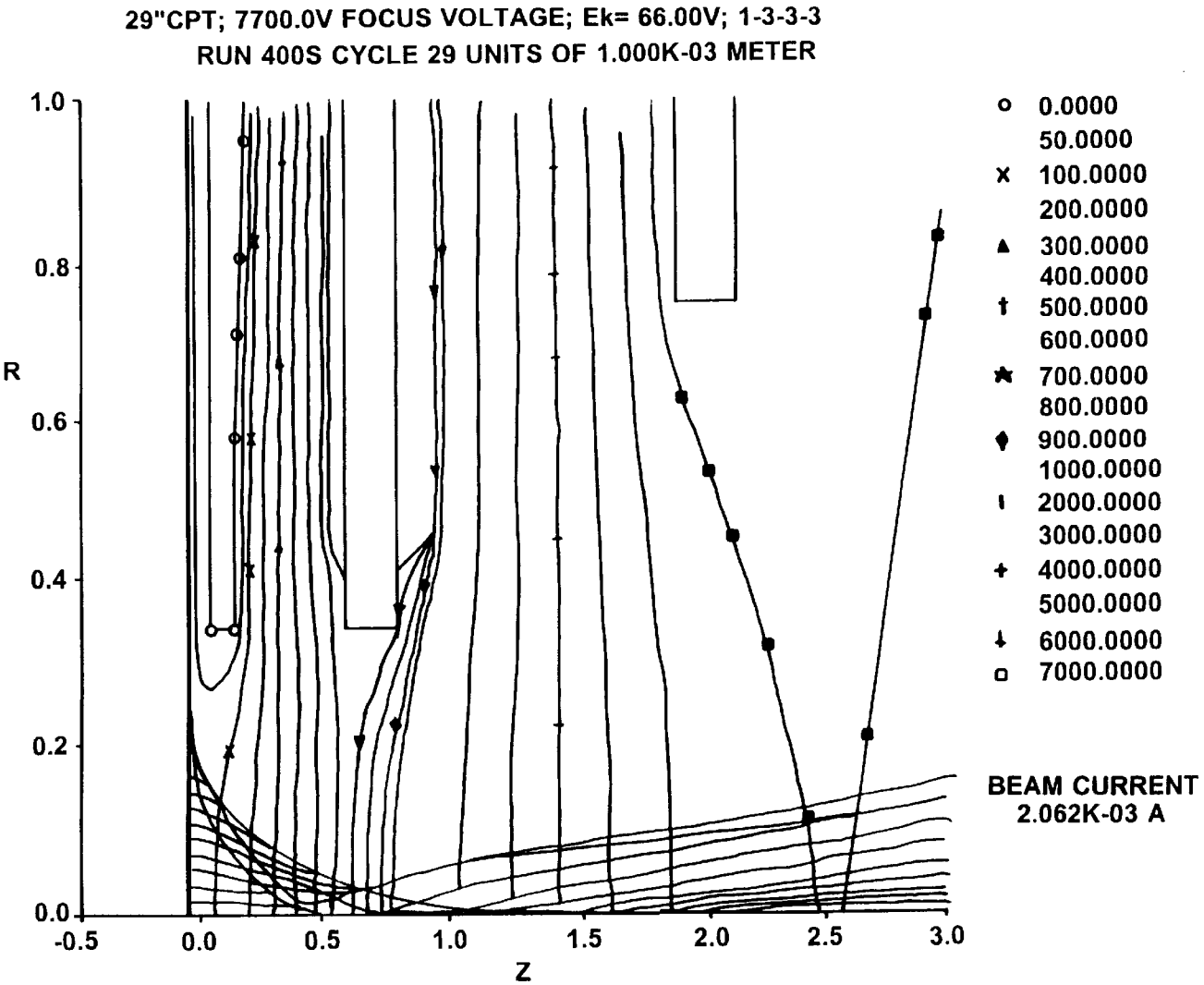

FIG. 11 is a graph representation plotting the trajectory of electron beams in the beam focusing region of the electron gun according to the present invention. It can be noted that the positions of the crossover points in the horizontal and vertical directions are not changed, but only the divergence angle is changed.

The following <Table> shows the result of measuring the aspect ratio of the electron beam spot on the screen at respective levels of the beam current, in which, it can be noted that the aspect ratio of the beam spot of the electron gun according to the present invention is larger than that of the conventional electron gun.

Figure 12B:
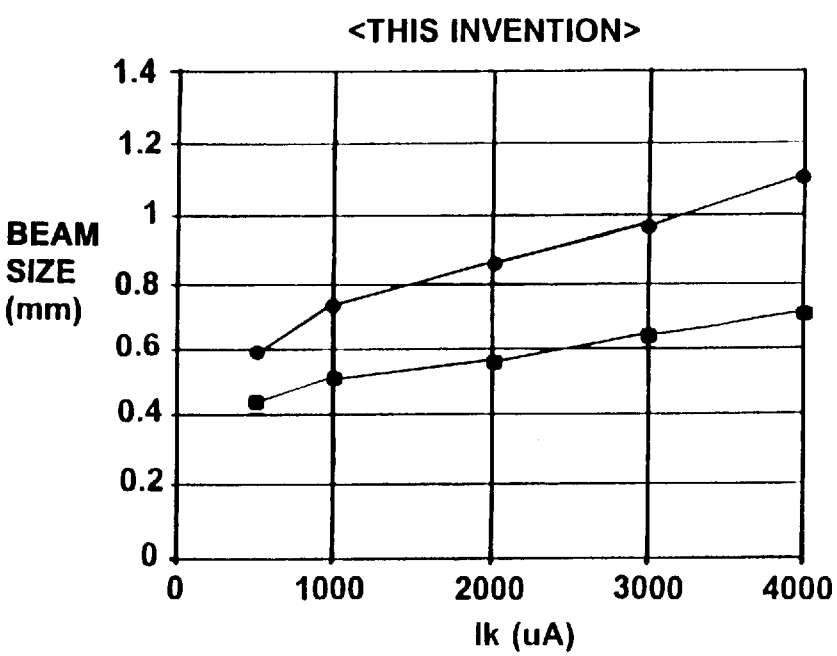
FIG. 12 is a graph representation plotting the beam size in a simulated state before incoming entering the main lens.
Figure 12A:
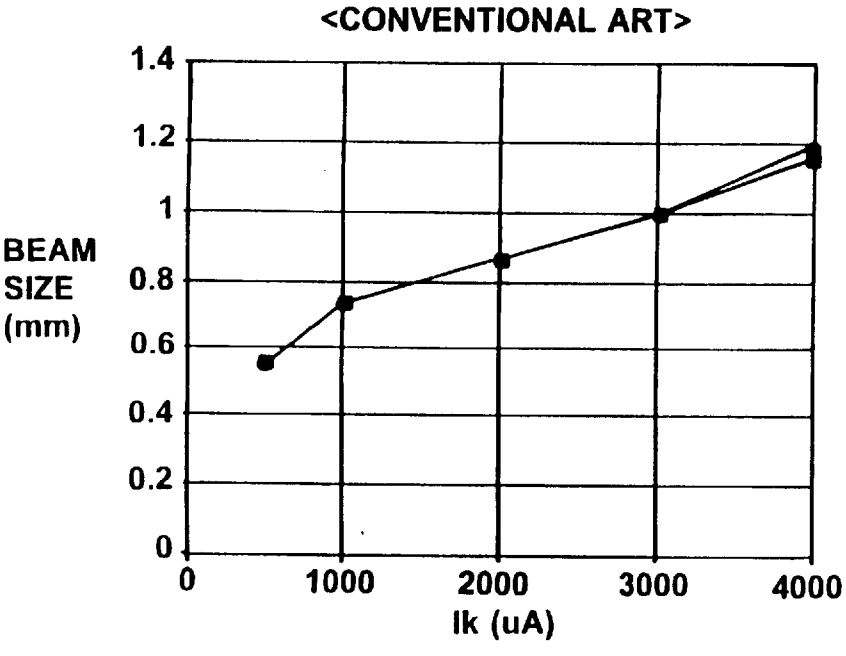
Figure 13B:
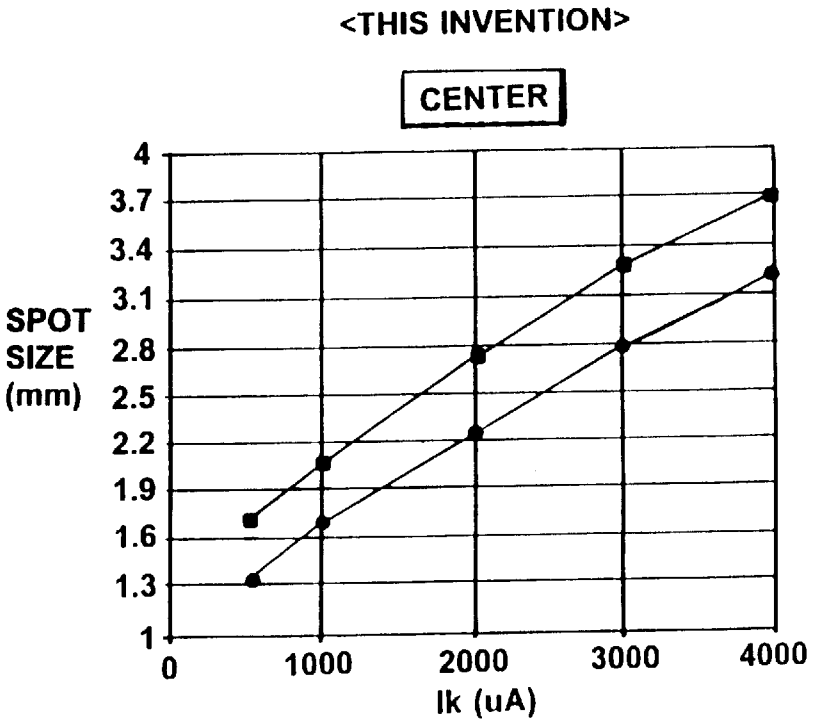
FIG. 13 is a graph representation plotting the spot size on the screen in the simulated state.
Figure 13A:
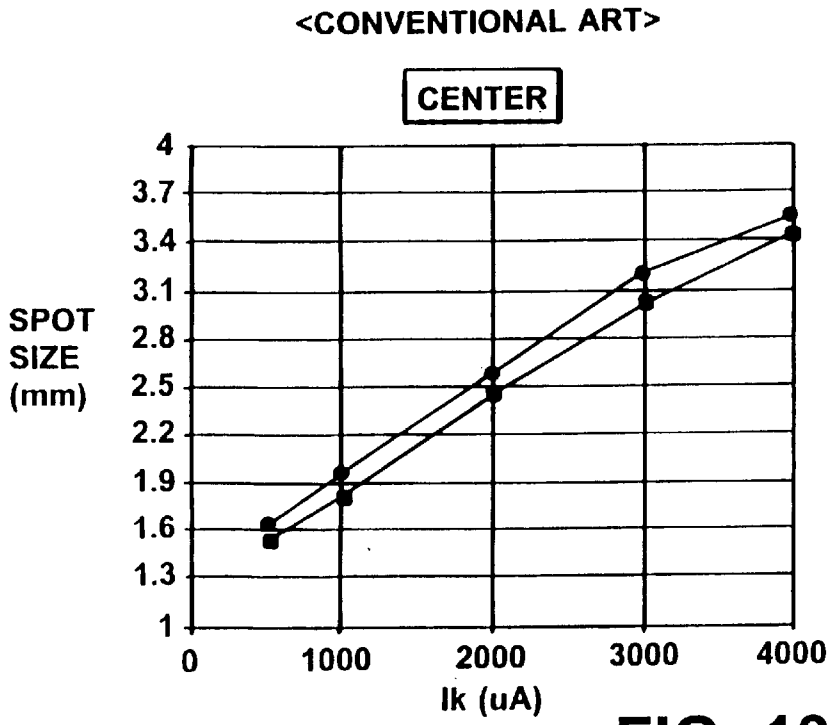
Figure 14B:
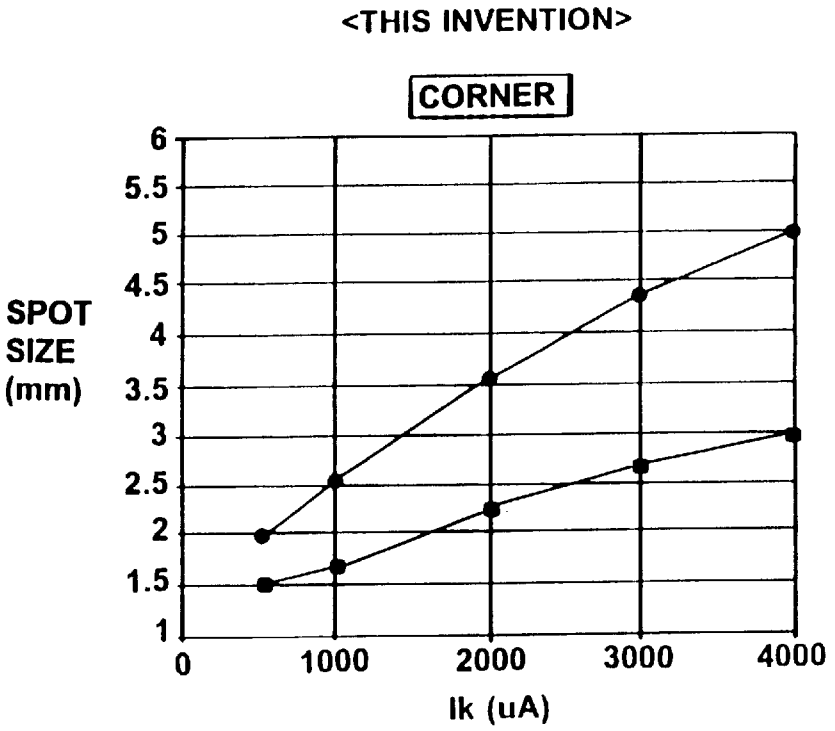
FIG. 14 is a graph representation plotting the beam size (computed value) before incoming entering the main lens and the spot size (actually-measured value) on the screen.
Figure 14A:
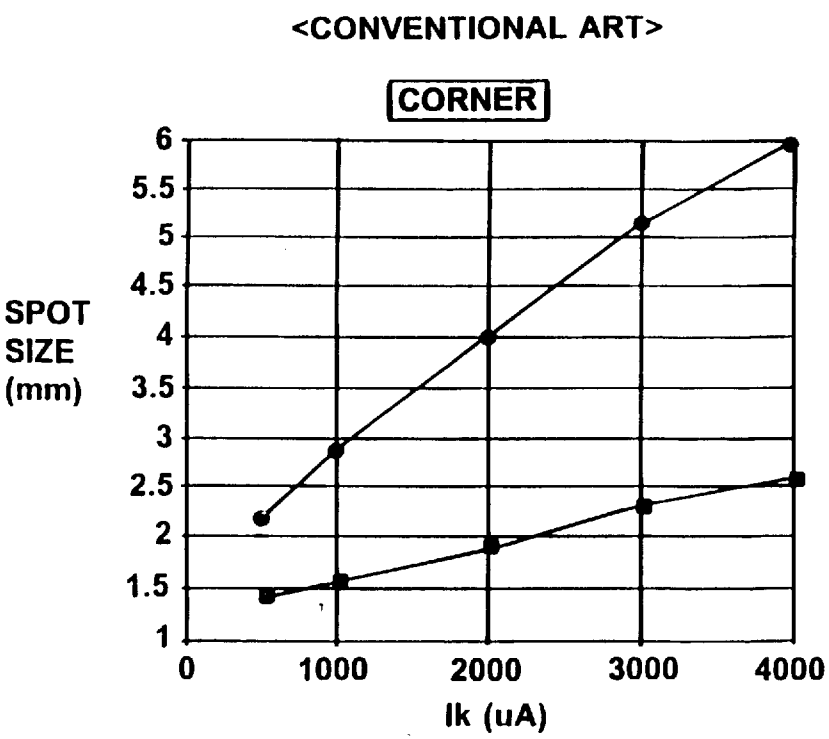

FIGS. 12 to 14 are graph representations plotting the actually-measured values of the beam spot size before reaching the main focusing lens by being compared with the conventional values. Here, the beam size having passed through the second grid is smaller in the vertical direction than in the horizontal direction. In actual practice, it is less subjected to the deflection aberration in the vertical direction on the periphery of the screen to make the difference in the horizontal and vertical directions small.

TABLE

| | Prior Art | | The Present Invention | |
|---|---|---|---|---|
| Classification Ik (uA) | Center | Periphery of Screen | Center | Periphery of Screen |
| 500 | 0.927 | 0.593 | 1.274 | 0.792 |
| 1000 | 0.918 | 0.498 | 1.211 | 0.662 |
| 2000 | 0.946 | 0.428 | 1.207 | 0.628 |
| 3000 | 0.940 | 0.392 | 1.175 | 0.591 |
| 4000 | 0.960 | 0.390 | 1.150 | 0.586 |

While the present invention has been particularly shown and described with reference to particular embodiments thereof, it will be understood by those skilled in the art that various changes in form and details may be effected therein without departing from the spirit and scope of the invention as defined by the appended claims.

What is claimed is:

1. An electron gun for a large-sized color cathode ray tube comprising:

three cathodes heated by a heater for emitting thermoelectrons;

a first grid placed next to said cathodes on one side of said cathodes for controlling the emitted thermoelectrons;

a second grid placed next to said first grid on the side of said first grid opposite said cathodes to accelerate the emitted thermoelectrons, said second grid having electron beam passing holes and further having similarly shaped and oriented rotary asymmetrical portions in both side faces around the electron beam passing holes;

a plurality of electrodes sequentially placed on the side of said second grid opposite said first grid for accelerating and focusing the incoming electron beams; and a bead glass for fixing said respective electrodes spaced apart by predetermined distances.

2. An electron gun for a large-sized color cathode ray tube as claimed in claim 1, wherein said similarly shaped and oriented rotary asymmetrical portions are formed as slits.

3. An electron gun for a large-sized color cathode ray tube as claimed in claim 2, wherein said slits are horizontal slits.

4. An electron gun for a large-sized color cathode ray tube as claimed in claim 1, wherein said second grid is formed by two plate electrodes, one plate electrode having a horizontal slit in one side face around said electron beam passing hole and forming one of said rotary asymmetrical portions, and the other plate electrode having another horizontal slit through the plate and forming the other of said rotary asymmetrical portions.

5. An electron gun for a large-sized color cathode ray tube as claimed in claim 1, wherein said second grid is formed by three plate electrodes, both-side plate electrodes having horizontal slits through them, and the sandwitched plate electrode having an electron beam passing hole through it.

6. An electron gun for a large-sized color cathode ray tube as claimed in claim 1, wherein each of said electron passing holes in said second grid has the same similarly oriented rotary asymmetrical portions in both side faces around electron beam passing holes for each of said cathodes.

7. An electron gun for a large-sized color cathode ray tube as claimed in claim 6, wherein said similarly shaped and oriented rotary asymmetrical portions are formed as slits.

8. An electron gun for a large-sized color cathode ray tube as claimed in claim 7, wherein said slits are horizontal slits.

9. An electron gun for a large-sized color cathode ray tube comprising:

three cathodes heated by a heater for emitting thermoelectrons;

a first grid placed on one side of said cathodes for controlling the emitted thermoelectrons;

a second grid placed on the side of said first grid opposite said cathodes to accelerate the emitted thermoelectrons, said second grid having three electron beam passing holes and further having similar rotary asymmetrical portions in both side faces around each of said three electron beam passing holes;

a plurality of electrodes sequentially placed on the side of said second grid opposite said first grid for accelerating and focusing the incoming electron beams; and a bead glass for fixing said respective electrodes spaced apart by predetermined distances.

10. An electron gun for a large-sized color cathode ray tube as claimed in claim 9, wherein said similar rotary asymmetrical portions are formed as depressions.

11. An electron gun for a large-sized color cathode ray tube as claimed in claim 10, wherein said depression are horizontal depressions.

* * * * *